US009259044B2

(12) United States Patent
Kim et al.

(10) Patent No.: US 9,259,044 B2
(45) Date of Patent: Feb. 16, 2016

(54) PACKAGE FOR HAIR PRODUCTS

(71) Applicant: SHAKE-N-GO FASHION, INC., Port Washington, NY (US)

(72) Inventors: James K. Kim, Manhasset, NY (US); Peter Ough, Bayside, NY (US); Hye Sun Kim, Port Washington, NY (US)

(73) Assignee: Shake-N-Go Fashion, Inc., Port Washington, NY (US)

( * ) Notice: Subject to any disclaimer, the term of this patent is extended or adjusted under 35 U.S.C. 154(b) by 0 days.

(21) Appl. No.: 14/597,040

(22) Filed: Jan. 14, 2015

(65) Prior Publication Data

US 2015/0223537 A1 Aug. 13, 2015

Related U.S. Application Data

(60) Provisional application No. 61/937,706, filed on Feb. 10, 2014.

(51) Int. Cl.

| | |
|---|---|
| ***A41G 5/00*** | (2006.01) |
| ***B65D 73/00*** | (2006.01) |
| ***B65D 85/00*** | (2006.01) |
| ***B65D 75/32*** | (2006.01) |

(52) U.S. Cl.

CPC ..... *A41G 5/004* (2013.01); *B65D 73/0014* (2013.01); *B65D 75/321* (2013.01); *B65D 85/70* (2013.01)

(58) Field of Classification Search

CPC ..... A45G 5/004; A45D 2/145; A45D 2/38; A45D 2/46; A45D 44/005; A45D 6/16; A45D 6/18; A45F 7/00–7/30; A45F 7/0021; B65D 25/101; B65D 71/02; B65D 71/50; B65D 73/00–73/02; B65D 73/0007; B65D 73/0014; B65D 85/18; B65D 85/70

USPC ..... 206/292, 293, 298, 477, 478, 8, 806; 223/84

See application file for complete search history.

(56) References Cited

U.S. PATENT DOCUMENTS

| | | | | | |
|---|---|---|---|---|---|
| 1,173,436 | A | * | 2/1916 | Julicher | 132/261 |
| 1,535,102 | A | | 6/1924 | Cohn | |
| 1,585,417 | A | * | 5/1926 | Robinson | 132/223 |
| 1,636,967 | A | * | 7/1927 | Perry | 132/211 |
| 2,191,571 | A | | 10/1937 | Lirette | |
| 2,375,087 | A | * | 5/1945 | De Bruin | 206/577 |
| 2,868,371 | A | | 7/1957 | Thorpe | |
| 3,837,476 | A | | 9/1974 | Schwartz | |
| 4,201,289 | A | | 5/1980 | Mack et al. | |
| 4,216,787 | A | * | 8/1980 | Moea | 132/250 |
| 4,739,776 | A | * | 4/1988 | Prijic | 132/224 |
| 5,312,015 | A | * | 5/1994 | Gelzer | 221/72 |
| 5,413,214 | A | * | 5/1995 | Schonke | 206/63.3 |
| 5,485,919 | A | | 1/1996 | Samberg et al. | |
| 5,816,408 | A | | 10/1998 | Indelicato | |

(Continued)

*Primary Examiner* — Anthony Stashick
*Assistant Examiner* — Mollie Llewellyn
(74) *Attorney, Agent, or Firm* — Greenberg Traurig, LLP

(57) ABSTRACT

The present invention relates to a package for a hair product having hair strands which include curls. The package includes a substantially planar panel for mounting the hair product thereto. The panel is elongated along a longitudinal axis. The package also includes a plurality of forms attached to the panel. The forms are arranged on the panel and spaced from each other along the longitudinal axis. Each of the forms has a curved portion for engaging and maintaining a corresponding set of the curls of the hair strands of the hair product.

10 Claims, 7 Drawing Sheets

(56) References Cited

U.S. PATENT DOCUMENTS

| | | | |
|---|---|---|---|
| 7,556,152 | B2 | 7/2009 | Lechelle |
| 7,886,905 | B2 | 2/2011 | Kamada |
| 8,025,065 | B2 | 9/2011 | Guliker |
| 8,439,237 | B2 | 5/2013 | Choi |
| 8,590,543 | B2 | 11/2013 | Goff et al. |
| 9,044,077 | B1 * | 6/2015 | Lin |
| 2003/0159962 | A1 | 8/2003 | Heo |
| 2004/0226858 | A1 | 11/2004 | Jhung |
| 2011/0284397 | A1 | 11/2011 | Batres et al. |
| 2012/0006696 | A1 | 1/2012 | Choi |
| 2012/0111742 | A1 | 5/2012 | Choi |
| 2015/0223536 | A1 | 8/2015 | Kim et al. |

* cited by examiner

PACKAGE FOR HAIR PRODUCTS

CROSS-REFERENCE TO RELATED APPLICATION

This application claims priority to U.S. Provisional Application No. 61/937,706 filed Feb. 10, 2014, the disclosure of which is incorporated herein by reference in its entirety.

FIELD OF THE INVENTION

The present invention relates to a package for hair products and, more particularly, to a package adapted for maintaining curls provided in hair pieces, such as a hair extension product.

BACKGROUND OF THE INVENTION

Hair products, such as hair extensions and wigs, have been provided in packages. Some hair extensions are provided with curls or waves in their hair strands.

SUMMARY OF THE INVENTION

In accordance with an embodiment of the present invention, a package is provided for packaging a hair product having hair strands which include curls. The package includes a substantially planar panel for mounting the hair product thereto. The panel is elongated along a longitudinal axis. The package also includes a plurality of forms attached to the panel. The forms are arranged on the panel and spaced from each other along the longitudinal axis. Each of the forms has a curved portion for engaging and maintaining a corresponding set of the curls of the hair strands of the hair product. In accordance with an embodiment of the present invention, the forms are arranged linearly. In accordance with another embodiment, the forms are arranged in a plurality of rows which are offset from each other. In accordance with yet another embodiment, the forms are provided with cylindrical shapes and are oriented in a direction substantially perpendicular to a longitudinal axis of the panel. Alternatively, the forms are provided with semi-circular shapes.

BRIEF DESCRIPTION OF THE DRAWINGS

For a more complete understanding of the present invention, reference is made to the following detailed description of an exemplary embodiments considered in conjunction with the accompanying drawings, in which.

DETAILED DESCRIPTION OF EMBODIMENTS OF THE INVENTION

Although the present invention can be used in conjunction with any type of hair products, it is particularly suitable for use in connection with a hair extension product. Accordingly, the present invention will be described hereinafter in connection with such a hair product. It should be understood, however, that the following description is only meant to be illustrative of the present invention and is not meant to limit the scope of the present invention, which has applicability to other types of hair products, including wigs and other hairpieces.

Figure 1:
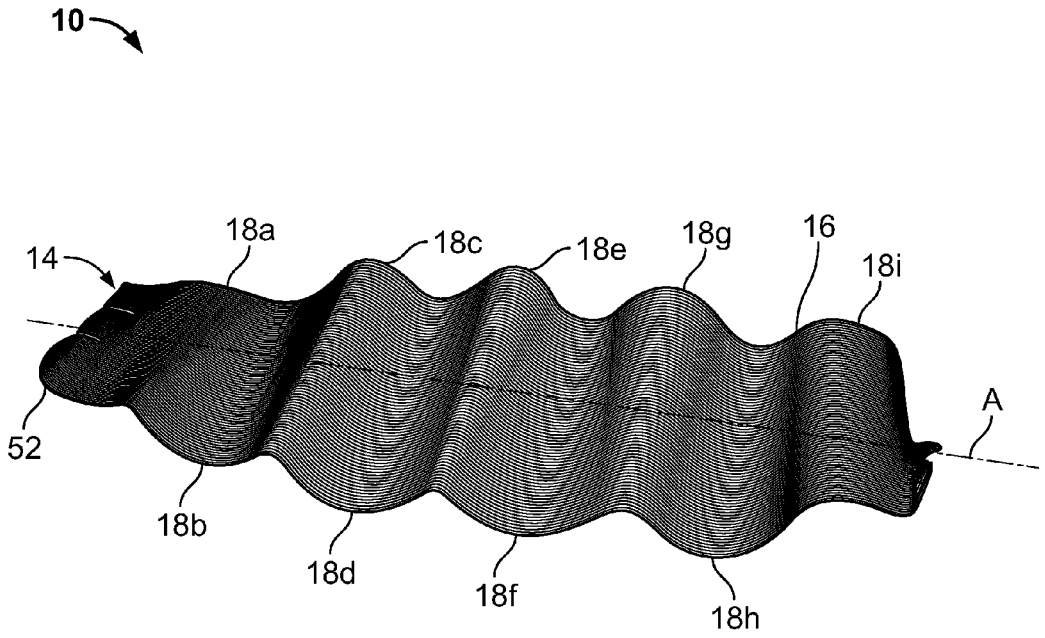
FIG. 1 is a perspective view of a hair extension product having laterally extending curls.
Figure 2:
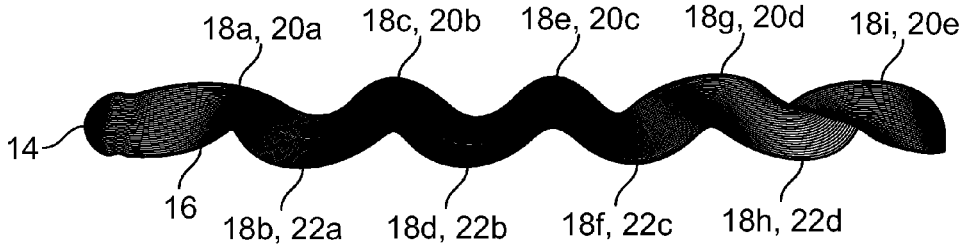
FIG. 2 is a side view of the hair extension product shown in FIG. 1.
Figure 3:
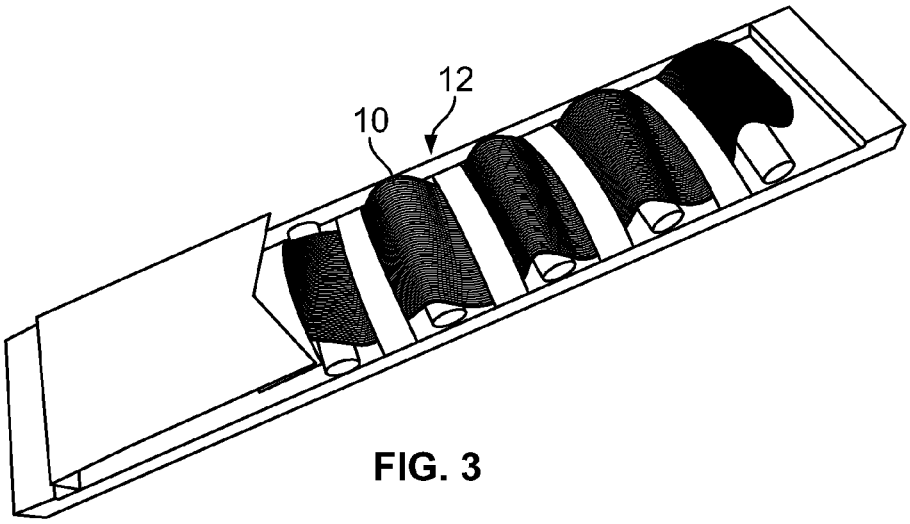
FIG. 3 is a perspective view of a package constructed in accordance with an embodiment of the present invention for packaging the hair extension product shown in FIG. 1.

With reference to FIGS. 1-3, a hair extension product 10 is packaged in a package 12 in accordance with an embodiment of the present invention. The hair extension product 10 is constructed and assembled in basically the same manner as a conventional hair extension product (such as the hair extension product sold by Shake-N-Go Fashion, Inc., Port Washington, N.Y., under the trademark XQ® SENSUOUS WAVE). For instance, the hair extension product 10 includes a weft or band 14, and a plurality of hair strands 16 depending from the weft 14 and extending generally along an axial direction (i.e., in direction generally parallel to a longitudinal axis A of the hair extension product 10, as shown in FIG. 1). The hair strands 16 are provided with a plurality of curls 18*a*-18*i* extending in a lateral direction, which is generally perpendicular to the axial direction (i.e., generally perpendicular to the longitudinal axis A of the hair extension product 10). When viewed laterally from a side of the hair extension product 10 (see FIG. 2), the curls 18*a*, 18*c*, 18*e*, 18*g*, 18*i* form peaks 20*a*-20*e*, respectively, while the curls 18*b*, 18*d*, 18*f*, 18*h* form valleys 22*a*-22*d*, respectively. The peaks 20*a*-20*e* and the valleys 22*a*-22*d* cooperate to define continuously extending waves. The curls 18*a*-18*i* are formed in a spaced manner such that each of them is spaced from an adjacent one or set of the curls 18*a*-18*i* by a predetermined distance.

Figure 4:
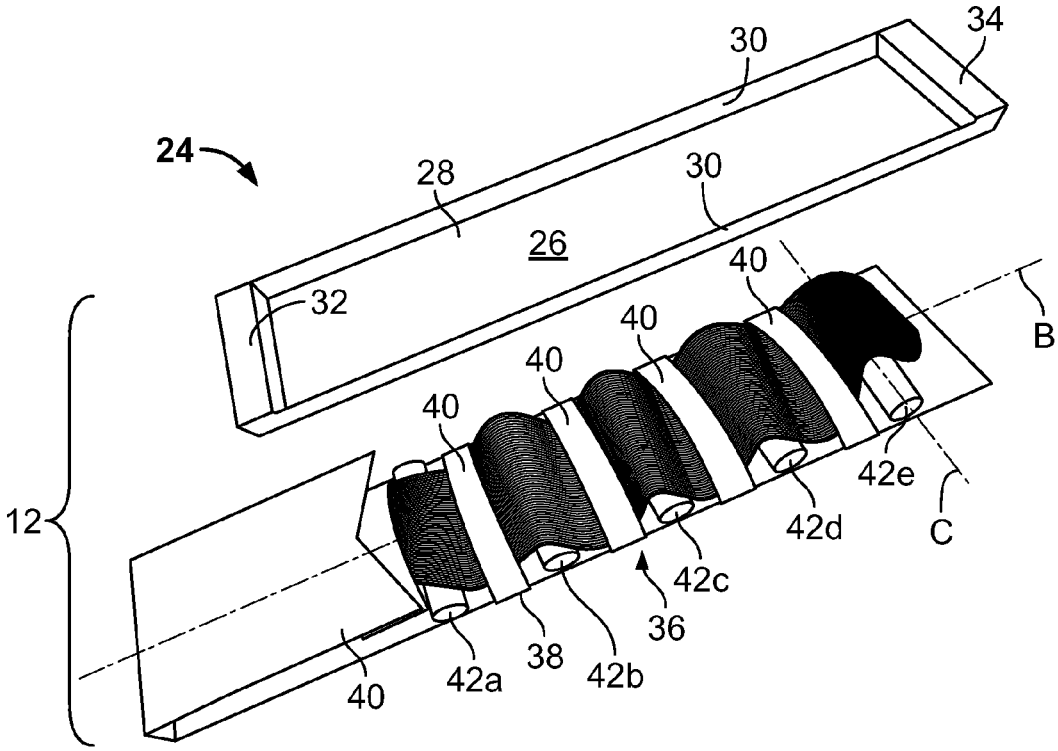
FIG. 4 is a partially exploded, perspective view the package shown in FIG. 3, the package having a container and an insert received in the container for packaging the hair extension product shown in FIG. 1.
Figure 5:
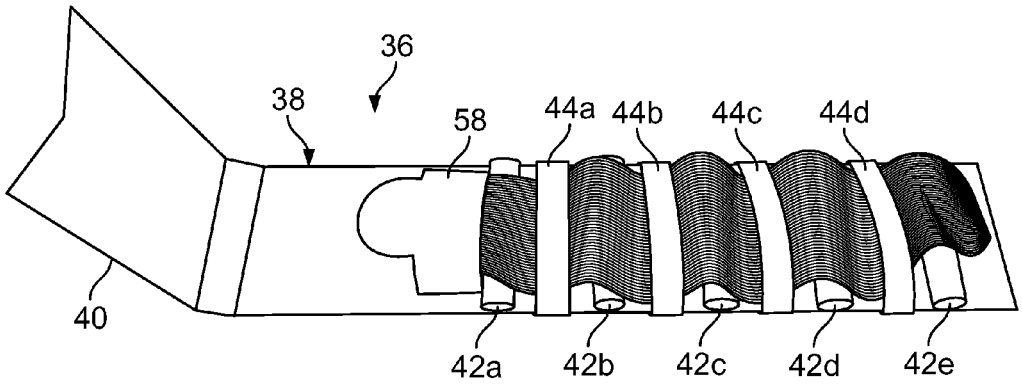
FIG. 5 is a top perspective view of the insert shown in FIG. 4.
Figure 6:
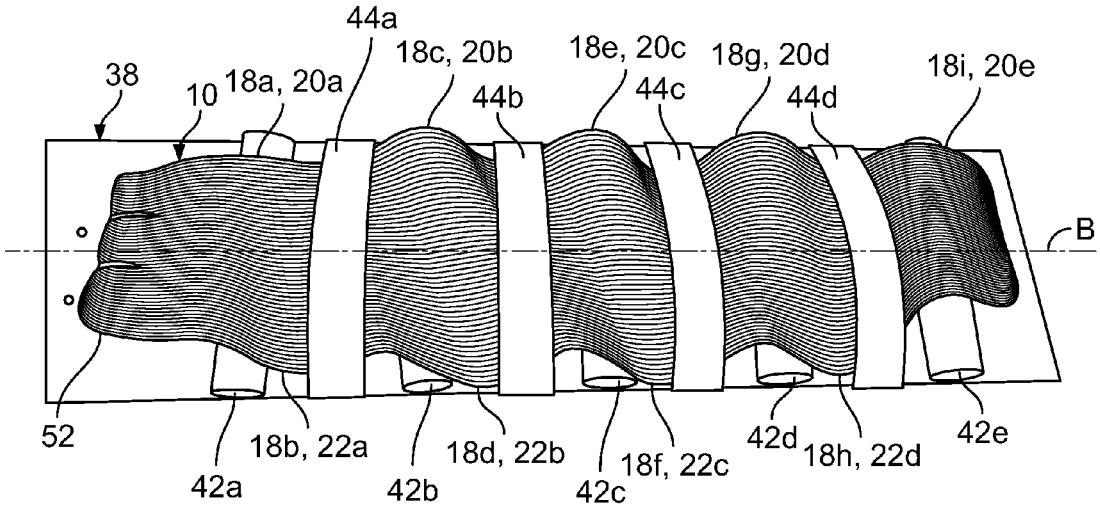
FIG. 6 is a top perspective view of a portion of the insert shown in FIG. 5.

Now referring to FIGS. 3 and 4, the package 12 includes an elongated container 24 having a receptacle 26 therein. The container 24 has a construction that is basically identical to a conventional container, such as the container for the hair extension product sold by Shake-N-Go Fashion, Inc., Port Washington, NY, under the trademark XQ®. For instance, the container 24 includes a back panel 28, a pair of side walls 30 and top and bottom walls 32, 34 cooperating to define the receptacle 26.

With reference to FIGS. 4-10, the package 12 also includes a package insert 36 adapted to be received in the receptacle 26. More particularly, the insert 36 includes an elongated mounting panel or member 38 and a header 40 attached to and folded over the mounting panel 38. The header 40 provides a space on which marketing materials, such one or more trademarks, logos, designs, etc., can be displayed. The mounting panel 38, which has a longitudinal axis B (see FIGS. 4 and 6), is substantially planar or flat and is provided with a plurality of forms 42*a*-42*e* arranged in a spaced manner on the mounting panel 38. Each of the forms 42*a*-42*e* has a substantially cylindrical shape (i.e., has a substantially circular cross section) and arranged such that its longitudinal axis C (see FIG. 4) is substantially perpendicular to the longitudinal axis B of the mounting panel 38. In one embodiment, each of the forms 42*a*-42*e* may be provided with another curved shape (e.g., oval, elliptical, etc.). In another embodiment, the forms 42*a*-42*e* may be provided with a portion having a curved shape (e.g., the forms 42*a*-42*b* may be provided with a semi-circular shape). The forms 42*a*-42*e* may be attached to the mounting panel 38 in any manner (e.g., glued, stapled, taped, etc.) so long as they remain substantially stationary relative to the mounting panel 38. The forms 42*a*-42*e*, which may be formed from any suitable material (e.g., Styrofoam, paper, fabric, plastic, metal, etc.), are located at preselected locations along the mounting panel 38 such that they support the peaks 20*a*-20*e* (see FIG. 2), respectively, of the hair extension product 10.

The package 12 also includes a plurality of mounting bands or strips 44*a*-44*d* (See FIGS. 4-9). More particularly, the bands 44*a*-44*d* are sized and shaped so as to wrap around the hair strands 16 and the mounting panel 38 adjacent the valleys 22*a*-22*d* (see FIG. 6), respectively. Each of the bands 44*a*-44*d* includes a pair of ends 46, 48 (see FIGS. 7 and 9) which are attached to each other at a rear side 50 of the mounting panel 38 such that the hair strands 16 are snuggly pressed against the mounting panel 38 at the valleys 22*a*-22*d*. The ends 46, 48 of the bands 44*a*-44*d* can be attached to one another in any conventional manner (e.g., gluing, staples, adhesive strips, etc.).

Figure 7:
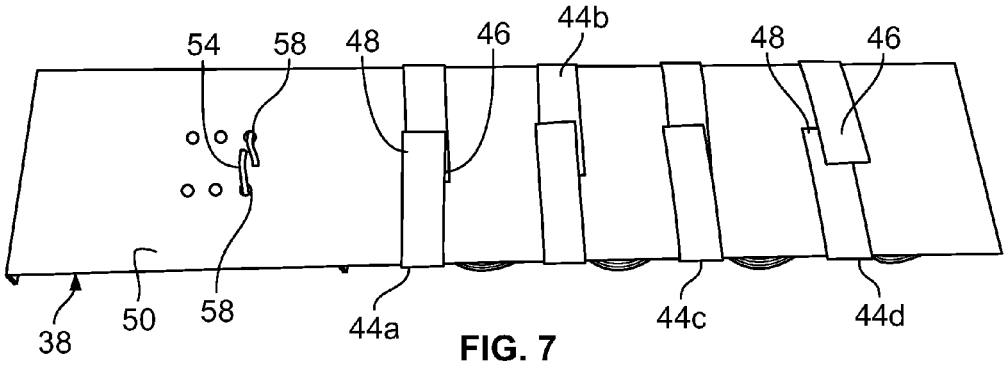
FIG. 7 is a bottom perspective view of the insert shown in FIG. 5.
Figure 8:
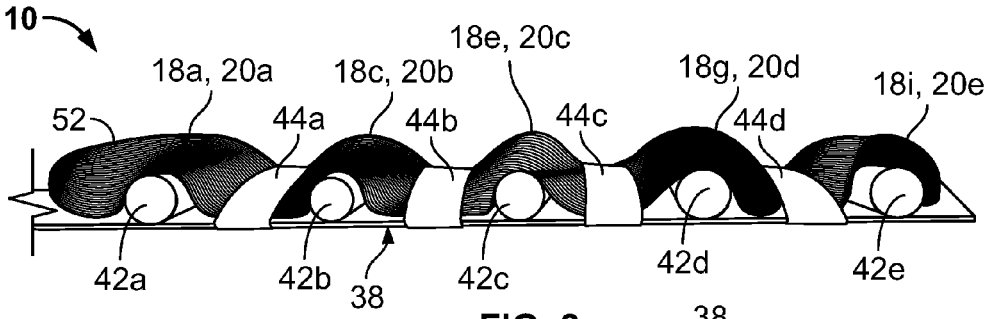
FIG. 8 is a side view of the portion of the insert shown in FIG. 6.
Figure 9:
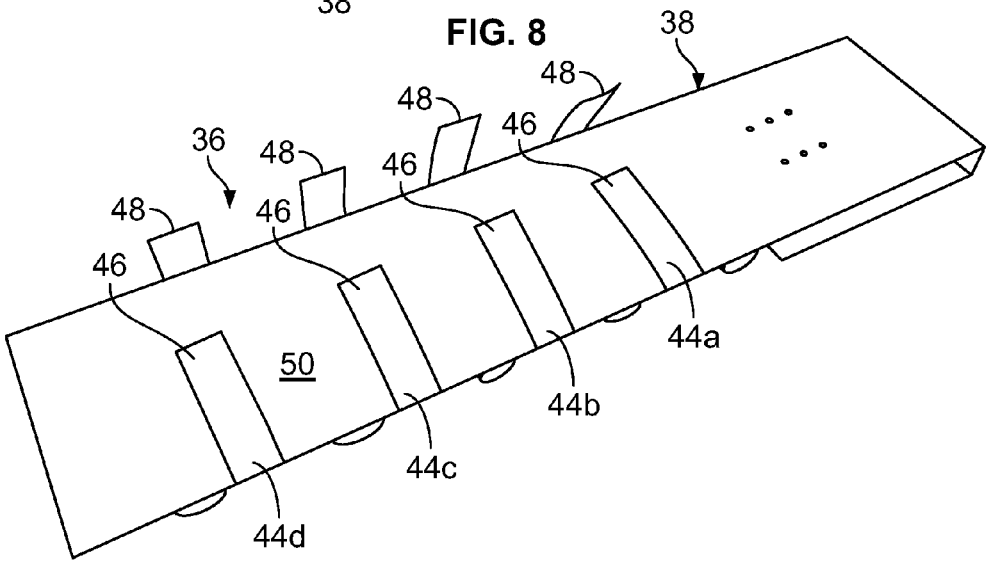
FIG. 9 is a bottom perspective view of the insert shown in FIG. 5, the insert having bands which are illustrated in FIG. 9 as partially detached.
Figure 10:
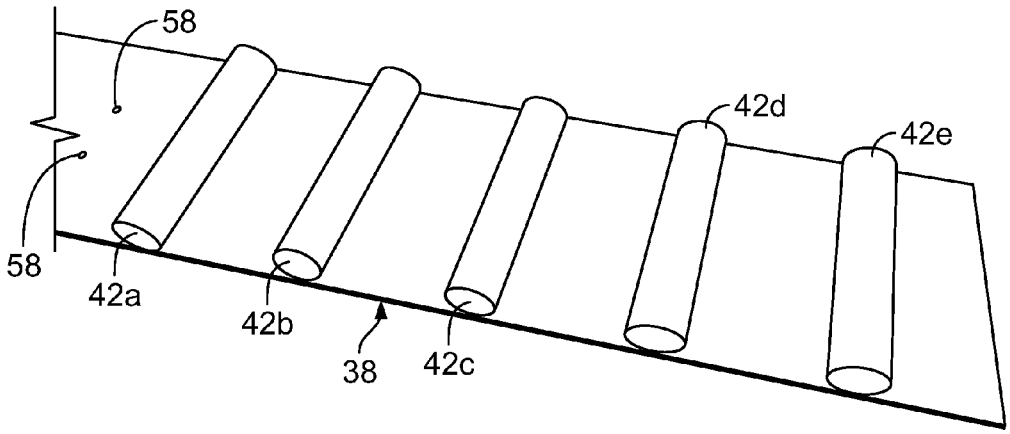
FIG. 10 is a top perspective view of the portion of the insert shown in FIG. 6 with the hair extension product removed.

The hair extension product 10 is packaged in the package 12 in accordance with an embodiment of the present invention. More particularly, the hair extension product 10 is folded over itself laterally such that the weft 14 is formed into a roll 52 (see FIG. 1). The roll 52 is secured to the mounting panel 38 adjacent an upper end thereof via a conventional mechanism (e.g., via one or more twist ties 54, as shown in FIG. 7). In this regard, the mounting panel 38 is provided with a pair of holes 58 (see FIGS. 7 and 10) for allowing the twist tie 54 to extend therethrough for securing the roll 52 of the hair extension product 10 to the mounting panel 38. The hair strands 16 are placed and arranged on the mounting panel 38 such that the peaks 20*a*-20*e* (i.e., the curls 18*a*, 18*c*, 18*e*, 18*g*, 18*i*, respectively) of the hair strands 16 are placed over the forms 42*a*-42*e*, respectively, while the valleys 22*a*-22*d* (i.e., the curls 18*b*, 18*d*, 18*f*, 18*h*, respectively) of the hair strands 16 are placed between an adjacent pair of the forms 42*a*-42*e* and rest directly on the mounting panel 38. The bands 44*a*-44*d* are placed over the hair strands 16 and the mounting panel 38 such that they snugly press the valleys 22*a*-22*d* against the mounting panel 38. A cover 58 (see FIG. 5) may optionally be placed over the roll 52 of the weft 14. After mounting the hair extension product 10 to the mounting panel 38 as discussed above, the package insert 36 is placed in the receptacle 26 of the container 24. A transparent or translucent outer sleeve or package may be placed over the container 24 to retain the package insert 36 and hence the hair extension product 10 in the container 24.

It should be appreciated that the present invention has numerous advantages and benefits. For instance, because the curls 18*a*, 18*c*, 18*e*, 18*g*, 18*i* of the hair strands 16 are supported by the forms 42*a*-42*e*, respectively, and the curls 18*b*, 18*d*, 18*f*, 18*h* are retained by the bands 44*a*-44*d*, respectively, the package 12 is able to maintain the shapes of the curls 18*a*-18*i*. Moreover, because the forms 42*a*-42*e* can be selectively attached to the mounting panel 38 at predetermined locations, the package 12 can accommodate many different types of hair extension products.

It should be noted that the present invention can be have numerous modifications and variations. For instance, the forms 42*a*-42*e* can be provided with different shapes or configurations and/or its number can be changed, depending on the shapes and sizes of the curls provided in the hair extension product 10. Moreover, one or more of the bands 44*a*-44*d* can be eliminated and/or replaced with other suitable mechanisms. In addition, the container 24 can be eliminated and/or replaced with other suitable means. For instance, the package insert 36 can be placed directly in an outer sleeve or package without being positioned in the container 24. Further, the package 12 can be modified for use in connection with other types of hair products, such as wigs or other hairpieces.

FIGS. 11-17 depict an alternate embodiment of the present invention. Elements illustrated in FIGS. 11-17, which correspond, either identically or substantially, to the elements described above with respect to the embodiment of FIGS. 1-10, have been designated by corresponding reference numerals increased by one hundred. Unless otherwise stated, the embodiment of FIGS. 11-17 is constructed, assembled and packaged in the same basic manner as the embodiment of FIGS. 1-10.

Figure 11:
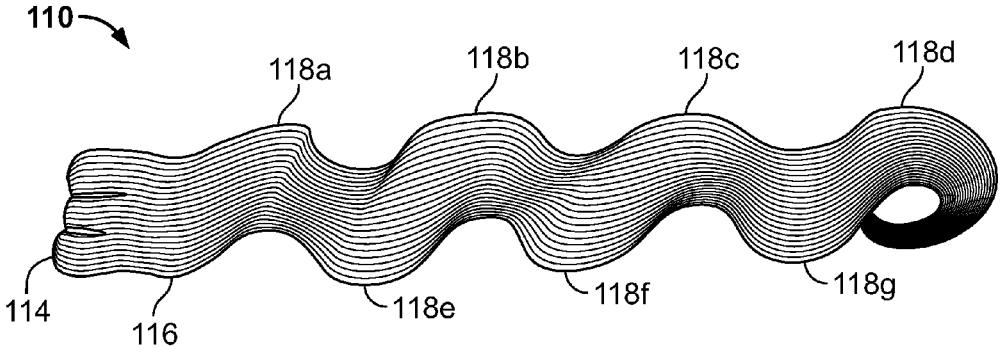
FIG. 11 is a plan view of another hair extension product having S-shaped curls.
Figure 12:
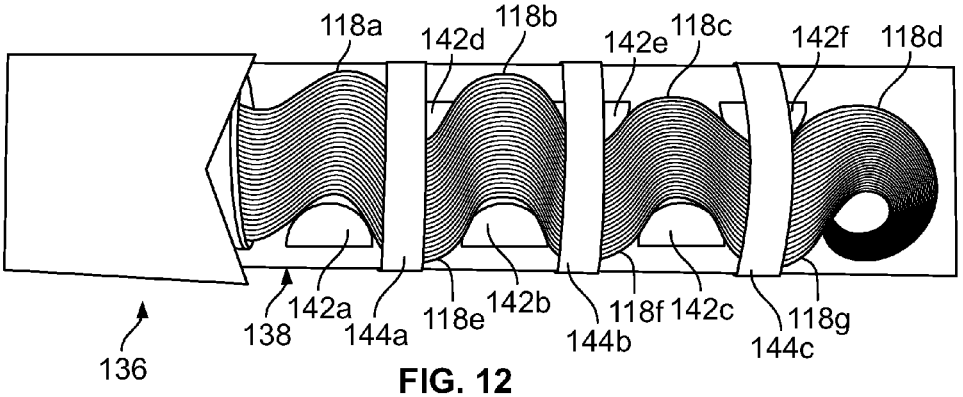
FIG. 12 is a plan view of a package insert constructed in accordance with an alternate embodiment of the present invention for packaging the hair extension product shown in FIG. 11.
Figure 13:
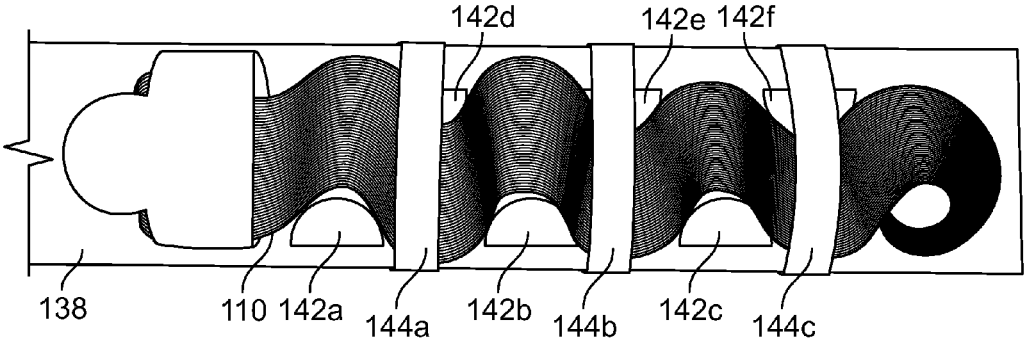
FIG. 13 is a plan view of a portion of the package shown in FIG. 12.
Figure 14:
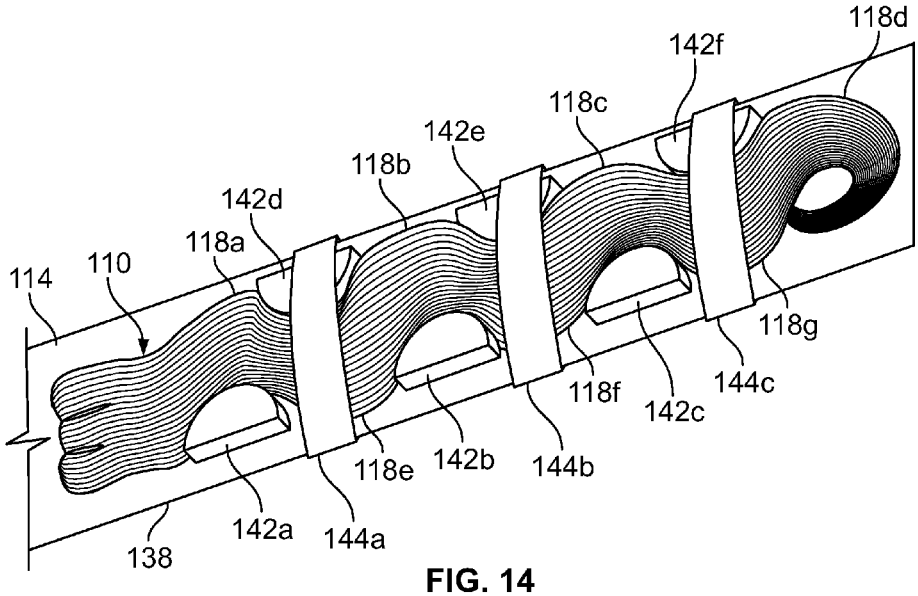
FIG. 14 is a perspective view of the portion of the package shown in FIG. 13.
Figure 15:
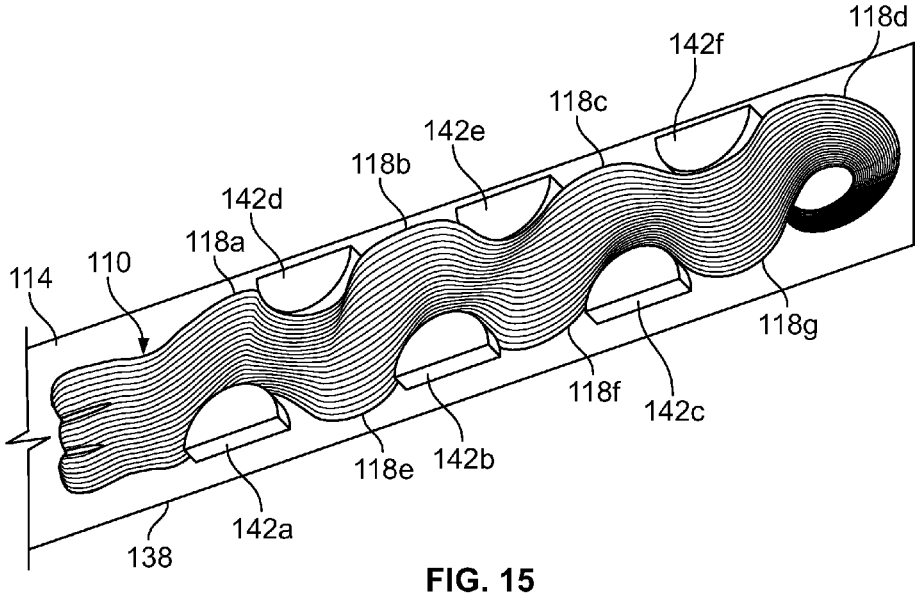
FIG. 15 is a view similar to FIG. 14, except that the package is shown without its retaining bands.
Figure 16:
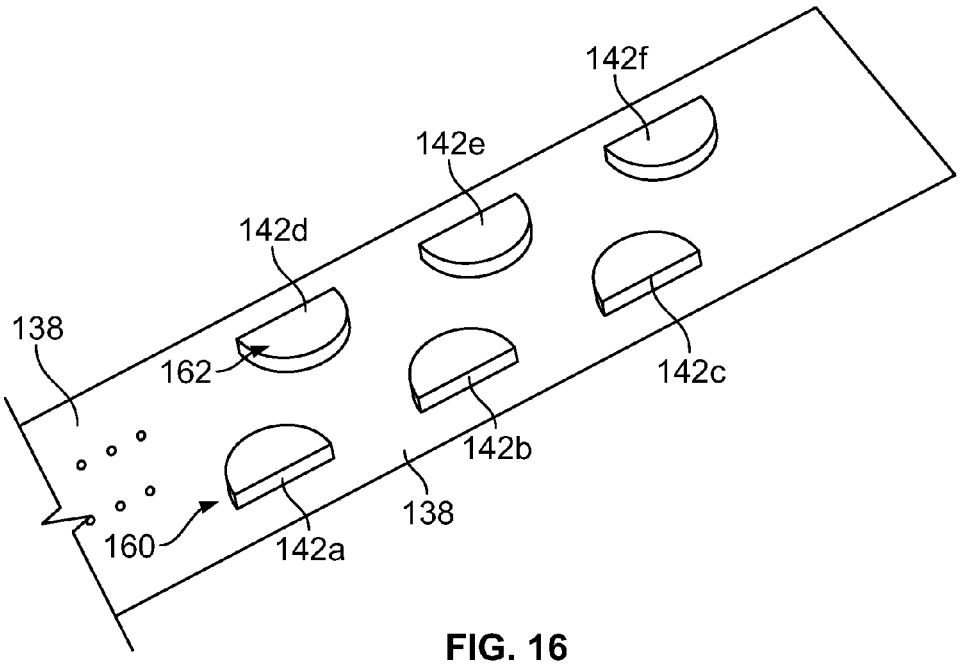
FIG. 16 is a perspective view of the portion of the package shown in FIG. 14 with the hair extension product removed.
Figure 17:
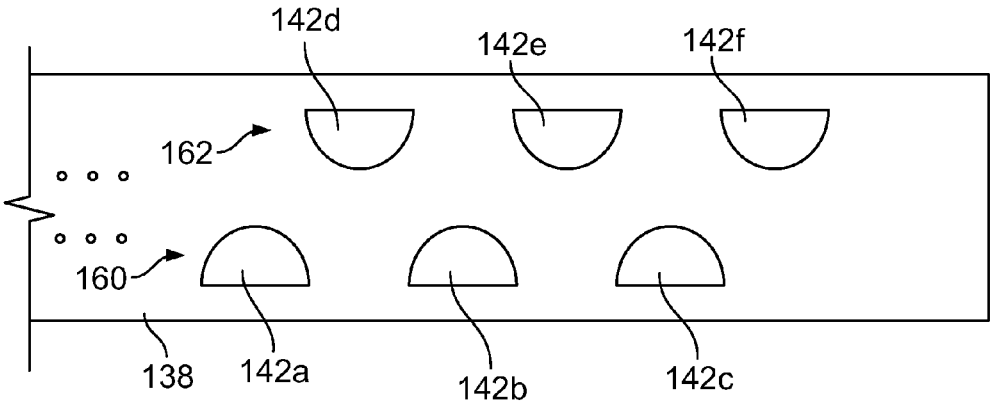
FIG. 17 is a plan view of the portion of the package shown in FIG. 16.

With reference to FIG. 11, a hair extension product 110 has a plurality of hair strands 116 depending from a weft 114. The hair extension product 110 includes a plurality of S-shaped curls 118*a*-118*g* in the hair strands 116.

A package insert 136 is provided for securing the hair extension product 110 thereto. The package insert 136 includes a mounting panel or member 138 and a plurality of forms 142*a*-142*f* attached thereto. The forms 142*a*-142*f*, each of which is provided with a semi-circular shape, are arranged and each have a thickness so as to retain the curls 118*a*-118*g* therebetween. More particularly, the forms 142*a*-142*c* are aligned with each other so as to form a substantially linear row 160 (see FIG. 17) adjacent one side of the mounting panel 138, while the forms 142*d*-142*f* are aligned with each other so as to form a substantially linear row 162 (see FIG. 17) adjacent an opposite side of the mounting panel 138. The rows 160, 162 are offset laterally relative to each other. Moreover, each of the forms 142*d*-142*f* is axially offset with respect to a corresponding one or set of the forms 142*a*-142*c* and vice versa. For instance, the form 142*d* is axially offset relative to each of the forms 142*a*, 142*b* such that it is positioned axially between the forms 142*a*, 142*b*. In this manner, the forms 142*a*-142*f* cooperate with each other so as to maintain the shapes of the curls 118*a*-118*g*. That is, the forms 142*a*-142*c* and the forms 142*d*-142*f* support the curls 118*a*-118*c* and the curls 118*d*-118*f*, respectively, such that the curls' curved shapes can be maintained by the forms 142*a*-142*f* Mounting bands 144*a*-144*c* are placed over the hair strands 116 so as to secure same to the mounting panel 128.

Once the hair extension product 110 and the package insert 136 are assembled together, they can be placed in a container similar to the container 24 of the embodiment shown in FIGS. 1-10. Alternatively, the assembled hair extension product 110 and the package insert 136 can be placed directly in an outer sleeve or package.

It should be noted that the package insert 136 provides numerous advantages and benefits. For instance, the forms 142*a*-142*f* cooperate with each other to form a sinusoidal pathway within which the strands 116 of the hair extension product 110 can be placed. Because the pathway substantially conforms to the curvature of the curls 118*a*-118*g* in the hair extension product 110, the forms 142*a*-14*f* cooperate to maintain the shapes of the curls 118*a*-118*g*. Additional forms can be provided to further define the pathway.

It will be understood that the embodiments described herein are merely exemplary and that a person skilled in the art may make many variations and modifications without departing from the spirit and scope of the invention. All such variations and modifications are intended to be included within the scope of the invention, as defined by the appended claims.

We claim:

1. A hair product packaging comprising a hair product having at least one weft and a plurality of hair strands, each of which is attached to said at least one weft, said at least one weft being formed into a roll, said hair strands including curls; and a package including a package insert and a container having a receptacle therein, said package insert including a substantially planar panel elongated along a longitudinal axis and having an end and a mounting area, said end and said mounting area being spaced from each other in a longitudinal direction parallel to said longitudinal axis, said roll of said at least one weft of said hair product being removably attached to said mounting area of said panel, said plurality of strands extending from said at least one weft toward said end of said panel, said package including a plurality of individual and discrete forms being attached to said panel, said forms being arranged on said panel and spaced from each other along said longitudinal axis between said end and said mounting area of said panel, each of said forms having a curved portion engaging and maintaining a corresponding set of said curls of said hair strands of said hair product, said package insert and said hair product being positioned in said receptacle of said container.

2. The packaging of claim 1, further comprising a plurality of bands attached to said panel, said bands being arranged and spaced from each other along said longitudinal axis.

3. The packaging of claim 2, wherein each of said forms is elongated along an axial axis, each of said forms being attached to said panel such that said axial axis of each of said forms being arranged substantially perpendicular to said longitudinal axis of said panel.

4. The packaging of claim 3, wherein each of said forms has a substantially cylindrical shape for engaging and maintaining at least some of said curls of said hair strands of said hair product.

5. The packaging of claim 4, wherein each of said bands is positioned between an adjacent pair of said forms for securing said hair strands of said hair product to said panel and for engaging the a corresponding set of said curls of said hair strands of said hair product.

6. The packaging of claim 2, wherein said forms include a first set of forms, each of which is positioned adjacent a first lateral side of said panel, and a second set of forms, each of which is positioned adjacent a second lateral side of said panel, said first lateral side being opposite from said second lateral side.

7. The packaging of claim 6, wherein said forms of said first set are arranged substantially linearly along said longitudinal axis of said panel for engaging at least some of said curls of said hair strands of said hair product; and wherein said forms of said second set are arranged substantially linearly along said longitudinal axis of said panel for engaging at least some of said curls of said hair strands of said hair product.

8. The packaging of claim 7, wherein said curved portion of each of said forms of said first set faces said second lateral side of said panel; and wherein said curved portion of each of said forms of said second set faces said first lateral side of said panel.

9. The packaging of claim 8, wherein each of said forms of said first set is offset from a corresponding one of said forms of said second set in a direction substantially parallel to said longitudinal axis of said panel.

10. The packaging of claim 9, wherein each of said bands is positioned between an adjacent pair of said forms of said first set for securing said hair strands of said hair product to said panel.

* * * * *